US009475997B2

(12) United States Patent
Broderick et al.

(10) Patent No.: US 9,475,997 B2
(45) Date of Patent: Oct. 25, 2016

(54) CONTAMINANT REMOVAL FROM HYDROCARBON STREAMS WITH CARBENIUM PSEUDO IONIC LIQUIDS

(71) Applicant: UOP LLC, Des Plaines, IL (US)

(72) Inventors: Erin M. Broderick, Arlington Heights, IL (US); Alakananda Bhattacharyya, Glen Ellyn, IL (US); Shurong Yang, Naperville, IL (US); Beckay J. Mezza, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 183 days.

(21) Appl. No.: 14/552,333

(22) Filed: Nov. 24, 2014

(65) Prior Publication Data

US 2016/0145501 A1 May 26, 2016

(51) Int. Cl.

| | |
|---|---|
| ***C10G 21/06*** | (2006.01) |
| ***C10G 67/04*** | (2006.01) |
| ***C10G 61/04*** | (2006.01) |
| ***C10G 55/06*** | (2006.01) |

(52) U.S. Cl.

CPC ..... *C10G 21/06* (2013.01); *C10G 55/06* (2013.01); *C10G 61/04* (2013.01); *C10G 67/04* (2013.01)

(58) Field of Classification Search

CPC ..... C10G 21/06; C10G 67/04; C10G 61/04; C10G 55/06

See application file for complete search history.

(56) References Cited

U.S. PATENT DOCUMENTS

| | | | |
|---|---|---|---|
| 7,001,504 | B2 | 2/2006 | Schoonover |
| 7,553,406 | B2 | 6/2009 | Wasserscheid et al. |
| 7,749,377 | B2 | 7/2010 | Serban et al. |
| 7,988,747 | B2 | 8/2011 | Lacheen et al. |
| 8,075,803 | B2 | 12/2011 | Kalb |
| 8,540,871 | B2 | 9/2013 | Zhan et al. |
| 8,597,517 | B2 | 12/2013 | Guzman Lucero et al. |
| 2006/0264642 | A1* | 11/2006 | Wasserscheid ..... B01J 31/0224 546/347 |
| 2010/0270211 | A1 | 10/2010 | Wolny |
| 2013/0026073 | A1 | 1/2013 | Martinez Palou et al. |

(Continued)

FOREIGN PATENT DOCUMENTS

| | | | |
|---|---|---|---|
| CN | 102443421 | A | 5/2010 |
| CN | 101210199 | B | 12/2010 |

(Continued)

OTHER PUBLICATIONS

Chen et al., "Deep oxidative desulfurization of diesel fuels by Lewis acidic ionic liquids," Journal of Molecular Catalysis A: Chemical (2012), vol. 359, 8-13.

(Continued)

*Primary Examiner* — Randy Boyer
*Assistant Examiner* — Juan Valencia

(57) ABSTRACT

Processes for removing sulfur and nitrogen contaminants from hydrocarbon streams are described. The processes include contacting the hydrocarbon stream comprising the contaminant with lean carbenium pseudo ionic liquid or a combination of carbenium pseudo ionic liquid and ionic liquid to produce a mixture comprising the hydrocarbon and rich carbenium pseudo ionic liquid or carbenium pseudo ionic liquid and ionic liquid comprising the contaminant. The mixture is separated to produce a hydrocarbon effluent and a rich carbenium pseudo ionic liquid or carbenium pseudo ionic liquid and ionic liquid effluent comprising the rich carbenium pseudo ionic liquid or carbenium pseudo ionic liquid and ionic liquid comprising the contaminant.

20 Claims, 2 Drawing Sheets

(56) References Cited

U.S. PATENT DOCUMENTS

| | | | |
|---|---|---|---|
| 2013/0118955 | A1 | 5/2013 | Victorovna Likhanova et al. |
| 2013/0248423 | A1 | 9/2013 | Serban et al. |

FOREIGN PATENT DOCUMENTS

| | | | |
|---|---|---|---|
| CN | 101338221 | B | 7/2011 |
| CN | 102453524 | A | 5/2012 |
| CN | 102732287 | A | 10/2012 |
| JP | 2005314500 | A2 | 11/2005 |
| WO | WO 02/34863 | A1 | 5/2002 |

OTHER PUBLICATIONS

Wang et al., "The Extractive Desulfurization of Fuels Using ionic Liquids Based on FeCl3," Petroleum Science and Technology (2010), 28(12), 1203-1210.

Zhang et al., "Extractive Desulfurization and Denitrogenation of Fuels Using Ionic Liquids," Industrial and Engineering Chemistry Research (2004), 43(2), 614-622.

Schmidt, Roland, "[bmim]AlCl4 Ionic Liquid for Deep Desulfurization of Real Fuels," Energy and Fuels (2008), 22(3), 1774-1778.

Jiang et al.,"Thermodynamic Properties of Caprolactam Ionic Liquids," Chinese Journal of Chemical Engineering (2013), 21(7), 766-769.

Huh et al., "Selective denitrogenation using Zn-containing ionic liquids as extractants," ACS National Meeting Book of Abstracts (2009), American Chemical Society—238th.

Jess et al., "Use of ionic liquids for desulfurization of product streams in crude oil treatment," Chemie-Ingenieur-Technik (2004), 76(9), 1407-1408.

Gao et al., "A Carbonium Pseudo Ionic Liquid with Excellent Extractive Desulfurization Performance," AIChE Journal, vol. 59, No. 3, Mar. 2013, pp. 948-958.

Gao et al., "Acylation Desulfurization of Oil Via Reactive Adsorption," AiChE Journal, vol. 59, No. 8, Aug. 2013, pp. 2966-2976.

Dharakskar et al, "Extractive Deep Desulfurization of Liquid Fuels Using Lewis-Based Ionic Liquids," Journal of Energy (2013), 4 pages.

Nie et al., "Fast oxidative desulfurization of fuel oil using dialkylpyridinium tetrachloroferrates ionic liquids," Fuel (2013), vol, 103, 997-1002.

Dong et al., "Highly efficient oxidative desulfurization of fuels by lewis acidic ionic liquids . . . ," Chemical Engineering & Technology (2013), 36(3), 435-442.

Yu et al., "Deep oxidative desulfurization of diesel fuels by acidic ionic liquids," Industrial & Engineering Chemistry Research (2011), vol. 50, 11690-11697.

Gao et al., "Desulfurization of diesel fuel by extraction with Lewis-acidic ionic liquid," Separation Science and Technology (2009), 44(4), 971-982.

* cited by examiner

CONTAMINANT REMOVAL FROM HYDROCARBON STREAMS WITH CARBENIUM PSEUDO IONIC LIQUIDS

BACKGROUND OF THE INVENTION

Various hydrocarbon streams, such as vacuum gas oil (VGO), light cycle oil (LCO), and naphtha, may be converted into higher value hydrocarbon fractions such as diesel fuel, jet fuel, naphtha, gasoline, and other lower boiling fractions in refining processes such as hydrocracking and fluid catalytic cracking (FCC). However, hydrocarbon feed streams for these materials often have high amounts of nitrogen which are more difficult to convert. For example, the degree of conversion, product yields, catalyst deactivation, and/or ability to meet product quality specifications may be adversely affected by the nitrogen content of the feed stream. It is known to reduce the nitrogen content of these hydrocarbon feed streams by catalytic hydrogenation reactions such as in a hydrotreating process unit. However, hydrogenation processes require high temperature and pressure.

Various processes using ionic liquids to remove sulfur and nitrogen compounds from hydrocarbon fractions are also known. U.S. Pat. No. 7,001,504 discloses a process for the removal of organosulfur compounds from hydrocarbon materials which includes contacting an ionic liquid with a hydrocarbon material to extract sulfur containing compounds into the ionic liquid. U.S. Pat. No. 7,553,406 discloses a process for removing polarizable impurities from hydrocarbons and mixtures of hydrocarbons using ionic liquids as an extraction medium. U.S. Pat. No. 7,553,406 also discloses that different ionic liquids show different extractive properties for different polarizable compounds.

Sulfur extraction has also been reported using Lewis hard acid $AlCl_3$ combined with tert-butyl chloride, n-butyl chloride, and tert-butyl bromide, A Carbonium Pseudo Ionic Liquid with Excellent Extractive Desulfurization Performance, AIChE Journal, Vol. 59, No. 3, p. 948-958, March 2013; and acylating reagents and Lewis acids, Acylation Desulfurization of Oil Via Reactive Adsorption, AIChE Journal, Vol. 59, No. 8, p. 2966-2976, August 2013. However, with some feeds, the amount of extract formed using these materials may be large, which could limit commercial application.

There remains a need in the art for improved processes that enable the removal of contaminants from hydrocarbon streams.

SUMMARY OF THE INVENTION

One aspect of the invention is process for removing a contaminant comprising at least one of sulfur and nitrogen from a hydrocarbon stream. In one embodiment, the process includes contacting the hydrocarbon stream comprising the contaminant with a lean carbenium pseudo ionic liquid to produce a mixture comprising the hydrocarbon and a rich carbenium pseudo ionic liquid comprising the contaminant. The carbenium pseudo ionic liquid comprises an organohalide and a metal halide, with the proviso that the organohalide is not a butyl halide or acyl halide. The mixture is separated to produce a hydrocarbon effluent and a rich carbenium pseudo ionic liquid effluent comprising the rich carbenium pseudo ionic liquid comprising the contaminant.

Another aspect of the invention is process for removing a contaminant comprising at least one of sulfur and nitrogen from a hydrocarbon stream. In one embodiment, the process includes contacting the hydrocarbon stream comprising the contaminant with a lean combination of a carbenium pseudo ionic liquid and an ionic liquid to produce a mixture comprising the hydrocarbon, and a rich combination of the carbenium pseudo ionic liquid and the ionic liquid comprising the contaminant. The carbenium pseudo ionic liquid comprises an organohalide and a metal halide. The mixture is separated to produce a hydrocarbon effluent and a rich effluent comprising the rich combination of the carbenium pseudo ionic liquid and the ionic liquid comprising the contaminant.

DETAILED DESCRIPTION OF THE INVENTION

Figure 1:
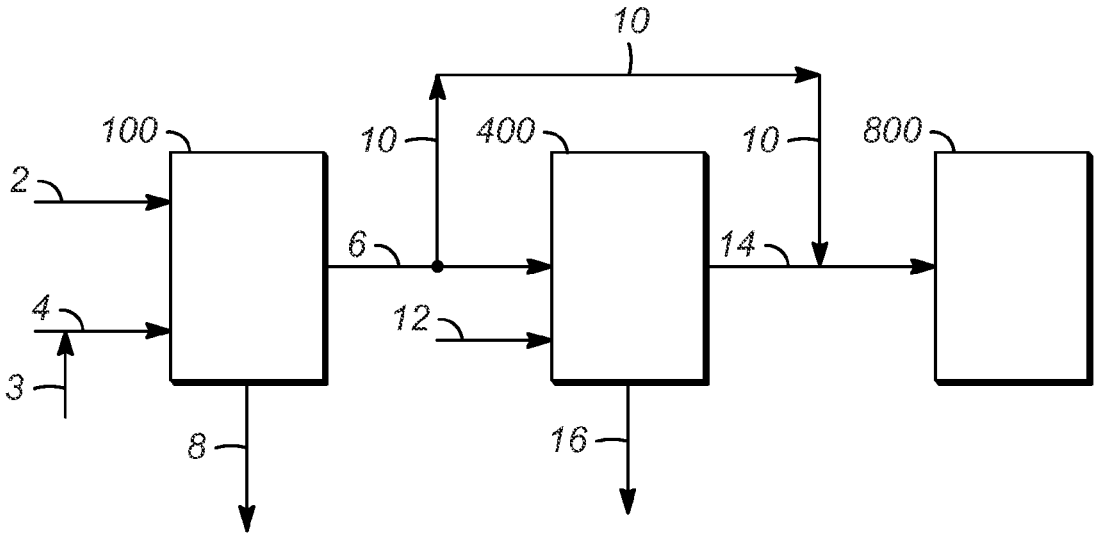
FIG. 1 is a simplified flow scheme illustrating various embodiments of the invention.

In general, the invention may be used to remove sulfur and nitrogen contaminants from a hydrocarbon stream using a carbenium pseudo ionic liquid or a combination of a carbenium pseudo ionic liquid and an ionic liquid. By "carbenium pseudo ionic liquid," we mean a combination of a Lewis acid and an organic halide that forms a polarized liquid.

The hydrocarbon stream typically has a boiling point in the range of about 30° C. to about 610° C. Examples of hydrocarbon streams include, but are not limited to, at least one of vacuum gas oil streams (boiling point (BP) of about 263° C. to about 583° C.), light cycle oil streams (BP of about 103° C. to about 403° C.), naphtha streams (BP of about 30° C. to about 200° C.), coker gas oil streams (BP of about 263° C. to about 603° C.), kerosene streams (BP of about 150° C. to about 275° C.), streams made from biorenewable sources, fracking condensate streams, streams from hydrocracking zones, streams from hydrotreating zones, and streams from fluid catalytic cracking zones.

The sulfur and nitrogen contaminants are one or more species found in the hydrocarbon material that is detrimental to further processing. The total sulfur content may range from 0.1 to 7 wt %, and the nitrogen content may be from about 40 ppm to 30,000 ppm.

The carbenium pseudo ionic liquid or carbenium pseudo ionic liquid and ionic liquid can remove one or more of the sulfur and nitrogen contaminants in the hydrocarbon feed. The hydrocarbon feed will usually comprise a plurality of nitrogen compounds of different types in various amounts. Thus, at least a portion of at least one type of nitrogen compound may be removed from the hydrocarbon feed. The same or different amounts of each type of nitrogen compound can be removed, and some types of nitrogen compounds may not be removed. In an embodiment, up to about 99.5 wt % of the nitrogen can be removed. The nitrogen content of the hydrocarbon feed is typically reduced by at least about 10 wt %, at least about 20 wt %, or at least about 30 wt %, or at least about 40 wt %, at least about 50 wt %, or at least about 60 wt %, or at least about 70 wt %, or at least about 80 wt %, or at least about 90 wt %, or at least about 95 wt %, or at least about 96 wt %, or at least about 97 wt %, or at least about 98 wt %, or at least about 99 wt %.

The hydrocarbon feed will typically also comprise a plurality of sulfur compounds of different types in various amounts. Thus, at least a portion of at least one type of sulfur compound may be removed from the hydrocarbon feed. The same or different amounts of each type of sulfur compound may be removed, and some types of sulfur compounds may not be removed. In an embodiment, up to about 95 wt % of the sulfur can be removed. Typically, the sulfur content of the hydrocarbon feed is reduced by at least about 25 wt %, or at least about 30 wt %, or at least 40 wt %, or at least 50 wt %, or at least 55 wt %, or at least 60 wt %, or at least 65 wt %, or at least 70 wt %, or at least 75 wt %, or at least about 80 wt %, or at least about 85 wt %, or at least about 90 wt %, or at least about 93 wt %.

Carbenium pseudo ionic liquids and ionic liquids suitable for use in the instant invention are hydrocarbon feed-immiscible carbenium pseudo ionic liquids and ionic liquids. As used herein the term "hydrocarbon feed-immiscible carbenium pseudo ionic liquid" or "hydrocarbon feed-immiscible ionic liquid" means the carbenium pseudo ionic liquid or ionic liquid is capable of forming a separate phase from the hydrocarbon feed under the operating conditions of the process. Carbenium pseudo ionic liquids and ionic liquids that are miscible with hydrocarbon feed at the process conditions will be completely soluble with the hydrocarbon feed; therefore, no phase separation will be feasible. Thus, hydrocarbon feed-immiscible carbenium pseudo ionic liquids and ionic liquids may be insoluble with or partially soluble with the hydrocarbon feed under the operating conditions. A carbenium pseudo ionic liquid or an ionic liquid capable of forming a separate phase from the hydrocarbon feed under the operating conditions is considered to be hydrocarbon feed-immiscible. Carbenium pseudo ionic liquids and ionic liquids according to the invention may be insoluble, partially soluble, or completely soluble (miscible) with water.

Consistent with common terms of art, the carbenium pseudo ionic liquid or carbenium pseudo ionic liquid and ionic liquid introduced to the contaminant removal zone may be referred to as a "lean" carbenium pseudo ionic liquid or carbenium pseudo ionic liquid and ionic liquid generally meaning a hydrocarbon feed-immiscible carbenium pseudo ionic liquid or carbenium pseudo ionic liquid and ionic liquid that is not saturated with one or more extracted contaminants. Lean carbenium pseudo ionic liquid or carbenium pseudo ionic liquid and ionic liquid is suitable for accepting or extracting contaminants from the hydrocarbon feed. Likewise, the carbenium pseudo ionic liquid or carbenium pseudo ionic liquid and ionic liquid effluent may be referred to as "rich", which generally means a hydrocarbon feed-immiscible carbenium pseudo ionic liquid or carbenium pseudo ionic liquid and ionic liquid effluent produced by a contaminant removal step or process or otherwise including a greater amount of extracted contaminants than the amount of extracted contaminants included in the lean carbenium pseudo ionic liquid or carbenium pseudo ionic liquid and ionic liquid.

The carbenium pseudo ionic liquid comprises an organohalide and a metal halide. Suitable organohalides include, but are not limited to, alkyl halides, isoalkyl halides, cycloalkyl halides, and combinations thereof. The organohalides can be chlorides, bromides, iodides, fluorides, and combinations thereof. In some embodiments, the alkyl halides and isoalkyl halides have 1-3 carbon atoms or 5-12 carbon atoms, and the cycloalkyl halides have 5-12 carbon atoms.

When the carbenium pseudo ionic liquid is used alone, the organohalides are not butyl halides or acyl halides. The amount of extract formed using carbenium pseudo ionic liquid made with butyl halides was large and may prohibit commercial application. Although the amount of extract formed when using acyl halides was less than for butyl halides, the amount of sulfur removed was lower.

Examples of suitable organohalides include, but are not limited to, methyl chloride, methyl bromide, ethyl chloride, ethyl bromide, propyl chlorides, propyl bromides, butyl chlorides, butyl bromides, cyclopentyl chlorides, cyclopentyl bromides, cyclohexyl chlorides, cyclohexyl bromides, isomers thereof, and combinations thereof.

Suitable metal halides include, but are not limited to, aluminum halides, iron halides, copper halides, zinc halides, cobalt halides, manganese halides, and combinations thereof. The metal halides can be chlorides, bromides, iodides, fluorides, and combinations thereof.

Typically, the same halide is used in the organohalide and the metal halide, although this is not required.

The ratio of the organohalide to the metal halide is generally in a range of about 1:4 to about 3:1, or about 1:4 to about 1:2, or about 1:4 to about 1:1.5, or about 1:1.

In order to reduce the amount of extract formed and/or improve the sulfur removal when using carbenium pseudo ionic liquids made with butyl halides and acyl halides, the carbenium pseudo ionic liquid can be mixed with an ionic liquid.

Generally, ionic liquids are non-aqueous, organic salts composed of a cation and an anion. These materials have low melting points, often below 100° C., undetectable vapor pressure, and good chemical and thermal stability. The cationic charge of the salt is localized over hetero atoms, such as nitrogen, phosphorous, and sulfur and the anions may be any inorganic, organic, or organometallic species.

In an embodiment, the hydrocarbon feed-immiscible ionic liquid comprises at least one of an imidazolium ionic liquid, a pyridinium ionic liquid, a phosphonium ionic liquid, a lactamium ionic liquid, an ammonium ionic liquid, and a pyrrolidinium ionic liquid.

In another embodiment, the hydrocarbon feed-immiscible ionic liquid consists essentially of imidazolium ionic liquids, pyridinium ionic liquids, phosphonium ionic liquids, lactamium ionic liquids, ammonium ionic liquids, pyrrolidinium ionic liquids, and combinations thereof. In still another embodiment, the hydrocarbon feed-immiscible ionic liquid is selected from the group consisting of imidazolium ionic liquids, pyridinium ionic liquids, phosphonium ionic liquids, lactamium ionic liquids, ammonium ionic liquids, pyrrolidinium ionic liquids, and combinations thereof. Imidazolium, pyridinium, lactamium, ammonium, and pyrrolidinium ionic liquids have a cation comprising at least one nitrogen atom. Phosphonium ionic liquids have a cation comprising at least one phosphorous atom.

Suitable anions for the ionic liquid include, but are not limited to, phosphates (including alkyl phosphates), phosphinates (including alkyl phosphinates), sulfates, sulfonates, carbonates, metalates, oxometalates (including polyoxometalates and mixed metalates), halides, tosylates, imides, borates, nitrates, and nitrites.

In an embodiment, the hydrocarbon feed-immiscible ionic liquid comprises at least one of 1-ethyl-3-methylimidazolium ethyl sulfate, 1-butyl-3-methylimidazolium hydrogen sulfate, 1-ethyl-3-methylimidazolium chloride, 1-butyl-3-methylimidazolium chloride, 1-butyl-3-methylimidazolium trifluoromethanesulfonate, 1-ethyl-3-methylimidazolium bis (trifluoromethylsulfonyl)imide, 1-butyl-3-methylimidazolium hexafluorophosphate, 1-butyl-3-methylimidazolium tetrafluoroborate, methylimidazolium trifluoroacetate, 1-butyl-3-methylimidazolium bromide, 1-ethyl-3-methylimidazolium trifluoroacetate, 1-methylimidazolium hydrogen sulfate, 1-butyl-4-methylpyridinium chloride, N-butyl-3-methylpyridinium methylsulfate, 1-butyl-4-methypyridinium hexafluorophosphate, pyridinium p-toluene sulfonate, 1-butylpyridinium chloride, tetraethylammonium acetate, trihexyl(tetradecyl)phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(ethyl)phosphonium diethylphosphate, tetrabutylphosphonium methanesulfonate, pyridinium p-toluene sulfonate, tributyl(methyl)phosphonium methylsulfate.

Lactamium ionic liquids include, but are not limited to, those described in U.S. Pat. No. 8,709,236, U.S. application Ser. No. 14/271,308, entitled Synthesis of Lactam Based Ionic Liquids, filed May 6, 2014, and U.S. application Ser. No. 14/271,319, entitled Synthesis of N-Derivatized Lactam Based Ionic Liquids, filed May 6, 2014, which are incorporated by reference.

The weight ratio of carbenium pseudo ionic liquid to the ionic liquid is in the range of about 1:1000 to about 1000:1, or about 1:1000 to about 1:10, or about 1:100 to about 1:10, or about 1:10 to about 10:1, or about 1:4 to about 4:1, or about 1:2 to about 2:1.

When a combination of carbenium pseudo ionic liquid and ionic liquid is used, they are typically mixed before being introduced into the contacting vessel, although this is not required.

In an embodiment, the invention is a process for removing sulfur and/or nitrogen contaminants from a hydrocarbon feed stream comprising a contacting step and a separating step. In the contacting step, a hydrocarbon feed stream comprising a contaminant, a hydrocarbon-immiscible carbenium pseudo ionic liquid or a hydrocarbon-immiscible combination of a carbenium pseudo ionic liquid and an ionic liquid (for ease of discussion, the process will be described for the carbenium pseudo ionic liquid) are contacted or mixed. The contacting may facilitate transfer or extraction of the one or more contaminants from the hydrocarbon feed stream to the carbenium pseudo ionic liquid. Although a carbenium pseudo ionic liquid that is partially soluble in the hydrocarbon may facilitate transfer of the contaminant from the hydrocarbon to the carbenium pseudo ionic liquid, partial solubility is not required. Insoluble hydrocarbon/carbenium pseudo ionic liquid mixtures may have sufficient interfacial surface area between the hydrocarbon and carbenium pseudo ionic liquid to be useful. In the separation step, the mixture of hydrocarbon and carbenium pseudo ionic liquid settles or forms two phases, a hydrocarbon phase and carbenium pseudo ionic liquid phase, which are separated to produce a hydrocarbon-immiscible carbenium pseudo ionic liquid effluent and a hydrocarbon effluent.

The process may be conducted in various equipment which is well known in the art and is suitable for batch or continuous operation. For example, in a small scale form of the invention, the hydrocarbon, and the hydrocarbon-immiscible carbenium pseudo ionic liquid may be mixed in a beaker, flask, or other vessel, e.g., by stirring, shaking, use of a mixer, or a magnetic stirrer. The mixing or agitation is stopped and the mixture forms a hydrocarbon phase and a carbenium pseudo ionic liquid phase which can be separated, for example, by decanting, centrifugation, or use of a pipette to produce a hydrocarbon effluent having a lower contaminant content relative to the incoming hydrocarbon. The process also produces a hydrocarbon-immiscible carbenium pseudo ionic liquid effluent comprising the one or more contaminants.

The contacting and separating steps may be repeated, for example, when the contaminant content of the hydrocarbon effluent is to be reduced further to obtain a desired contaminant level in the ultimate hydrocarbon product stream from the process. Each set, group, or pair of contacting and separating steps may be referred to as a contaminant removal step. Thus, the invention encompasses single and multiple contaminant removal steps. A contaminant removal zone may be used to perform a contaminant removal step. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The contaminant removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

FIG. 1 is a flow scheme illustrating various embodiments of the invention and some of the optional and/or alternate steps and apparatus encompassed by the invention. Hydrocarbon feed stream 2 and hydrocarbon-immiscible carbenium pseudo ionic liquid stream 4 are introduced to and contacted and separated in contaminant removal zone 100 to produce contaminant rich hydrocarbon-immiscible carbenium pseudo ionic liquid effluent stream 8 and hydrocarbon effluent stream 6 as described above. The carbenium pseudo ionic liquid stream 4 may be comprised of fresh carbenium pseudo ionic liquid stream 3. In an embodiment, a portion or all of hydrocarbon effluent stream 6 is passed via conduit 10 to a hydrocarbon conversion zone 800. Hydrocarbon conversion zone 800 may, for example, comprise at least one of a fluid catalytic cracking and a hydrocracking process, which are well known in the art.

The contacting step can take place at a temperature in the range of about −20° C. to about 200° C., or about 20° C. to about 150° C., or about 20° C. to about 120° C., or about 20° C. to about 100° C., or about 20° C. to about 80° C.

The contacting step takes place in an inert atmosphere, such as nitrogen, helium, argon, and the like, without oxygen or moisture.

The contacting step typically takes place at atmospheric pressure, although higher or lower pressures could be used, if desired. The pressure can be in the range of about 100 kPa(g) to about 3 MPa(g), for example.

The weight ratio of hydrocarbon feed to lean carbenium pseudo ionic liquid (or lean carbenium pseudo ionic liquid and ionic liquid) introduced to the contaminant removal step may range from about 1:10,000 to about 10,000:1, or about 1:1,000 to about 1,000:1, or about 1:100 to about 100:1, or about 1:20 to about 20:1, or about 1:10 to about 10:1, or about 1:1 to about 1:1,000. In an embodiment, the weight of hydrocarbon feed is greater than the weight of carbenium pseudo ionic liquid introduced to the contaminant removal step.

The contacting time is sufficient to obtain good contact between the carbenium pseudo ionic liquid and the hydrocarbon feed. The contacting time is typically in the range of about 1 min to about 2 hr, or about 1 min to about 1 hr, or about 5 min to about 30 min. The settling time may range from about one minute to about eight hours.

An optional hydrocarbon washing step may be used, for example, to remove carbenium pseudo ionic liquid that is entrained or otherwise remains in the hydrocarbon effluent stream 6 by using water to dissolve the carbenium pseudo ionic liquid in the hydrocarbon effluent. In this embodiment, a portion or all of hydrocarbon effluent stream 6 (as feed) and a water stream 12 (as solvent) are introduced to hydrocarbon washing zone 400. The hydrocarbon effluent and water streams introduced to hydrocarbon washing zone 400 are mixed and separated to produce a washed hydrocarbon stream 14 and a spent water stream 16, which comprises the dissolved carbenium pseudo ionic liquid. The hydrocarbon washing step may be conducted in a similar manner and with similar equipment as used to conduct other liquid-liquid wash and extraction operations as discussed above. Various hydrocarbon washing step equipment and conditions such as temperature, pressure, times, and solvent to feed ratio may be the same as or different from the contaminant removal zone equipment and conditions. In general, the hydrocarbon washing step conditions will fall within the same ranges as given for the contaminant removal step conditions. A portion or all of the washed hydrocarbon stream 14 may be passed to hydrocarbon conversion zone 800.

Figure 2A:
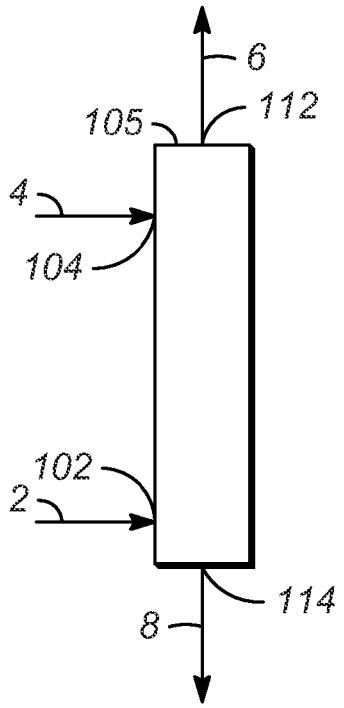
FIGS. 2A and 2B are simplified flow schemes illustrating different embodiments of an extraction zone of the invention.

FIG. 2A illustrates an embodiment of the invention which may be practiced in contaminant removal or extraction zone 100 that comprises a multi-stage, counter-current extraction column 105 wherein hydrocarbon and hydrocarbon-immiscible carbenium pseudo ionic liquid are contacted and separated. The hydrocarbon feed stream 2 enters extraction column 105 through hydrocarbon feed inlet 102, and lean carbenium pseudo ionic liquid stream 4 enters extraction column 105 through carbenium pseudo ionic liquid inlet 104. In the Figures, reference numerals of the streams and the lines or conduits in which they flow are the same. Hydrocarbon feed inlet 102 is located below carbenium pseudo ionic liquid inlet 104. The hydrocarbon effluent passes through hydrocarbon effluent outlet 112 in an upper portion of extraction column 105 to hydrocarbon effluent conduit 6. The hydrocarbon-immiscible carbenium pseudo ionic liquid effluent including the contaminants removed from the hydrocarbon feed passes through carbenium pseudo ionic liquid effluent outlet 114 in a lower portion of extraction column 105 to carbenium pseudo ionic liquid effluent conduit 8.

Figure 2B:
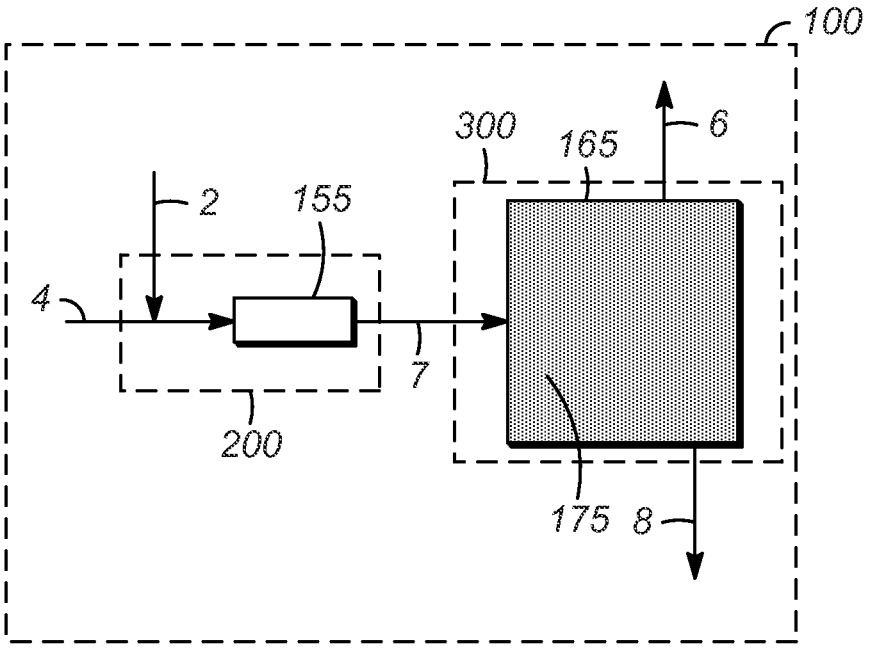

FIG. 2B illustrates another embodiment of contaminant removal zone 100 that comprises a contacting zone 200 and a separation zone 300. In this embodiment, lean carbenium pseudo ionic liquid stream 4 and hydrocarbon feed stream 2 are introduced into the contacting zone 200 and mixed by introducing hydrocarbon feed stream 2 into the flowing lean carbenium pseudo ionic liquid stream 4 and passing the combined streams through static in-line mixer 155. Static in-line mixers are well known in the art and may include a conduit with fixed internals such as baffles, fins, and channels that mix the fluid as it flows through the conduit. In other embodiments, not illustrated, lean carbenium pseudo ionic liquid stream 4 may be introduced into hydrocarbon feed stream 2. In another embodiment, lean carbenium pseudo ionic liquid stream 4 and hydrocarbon feed stream 2 are separately introduced into the static in-line mixer 155. In other embodiments, the streams may be mixed by any method well known in the art, including stirred tank and blending operations. The mixture comprising hydrocarbon and carbenium pseudo ionic liquid is transferred to separation zone 300 via transfer conduit 7. Separation zone 300 comprises separation vessel 165 wherein the two phases are allowed to separate into a rich carbenium pseudo ionic liquid phase which is withdrawn from a lower portion of separation vessel 165 via carbenium pseudo ionic liquid effluent conduit 8 and a hydrocarbon phase which is withdrawn from an upper portion of separation vessel 165 via hydrocarbon effluent conduit 6. Separation vessel 165 may comprise a boot, not illustrated, from which contaminant rich carbenium pseudo ionic liquid is withdrawn via conduit 8.

Separation vessel 165 may contain a solid media 175 and/or other coalescing devices which facilitate the phase separation. In other embodiments, the separation zone 300 may comprise multiple vessels which may be arranged in series, parallel, or a combination thereof. The separation vessels may be of any shape and configuration to facilitate the separation, collection, and removal of the two phases. In a further embodiment, contaminant removal zone 100 may include a single vessel wherein lean carbenium pseudo ionic liquid stream 4 and hydrocarbon feed stream 2 are mixed, then remain in the vessel to settle into the hydrocarbon effluent and rich carbenium pseudo ionic liquid phases.

In an embodiment, the process comprises at least two contaminant removal steps. For example, the hydrocarbon effluent from one contaminant removal step may be passed directly as the hydrocarbon feed to a second contaminant removal step. In another embodiment, the hydrocarbon effluent from one contaminant removal step may be treated or processed before being introduced as the hydrocarbon feed to the second contaminant removal step. There is no requirement that each contaminant removal zone comprises the same type of equipment. Different equipment and conditions may be used in different contaminant removal zones.

The contaminant removal step may be conducted under contaminant removal conditions including temperatures and pressures sufficient to keep the hydrocarbon-immiscible carbenium pseudo ionic liquid and hydrocarbon feeds and effluents as liquids. For example, the contaminant removal step temperature may range between about −20° C. and less than the decomposition temperature of the carbenium pseudo ionic liquid, and the pressure may range between about atmospheric pressure and about 3 MPa(g). When the hydrocarbon-immiscible carbenium pseudo ionic liquid comprises more than one carbenium pseudo ionic liquid component, the decomposition temperature of the carbenium pseudo ionic liquid is the lowest temperature at which any of the carbenium pseudo ionic liquid components decompose. The contaminant removal step may be conducted at a uniform temperature and pressure, or the contacting and separating steps of the contaminant removal step may be operated at different temperatures and/or pressures. In an embodiment, the contacting step is conducted at a first temperature, and the separating step is conducted at a temperature at least 5° C. lower than the first temperature. In a non-limiting example, the first temperature is about 80° C. Such temperature differences may facilitate separation of the hydrocarbon and carbenium pseudo ionic liquid phases.

The above and other contaminant removal step conditions such as the contacting or mixing time, the separation or settling time, and the ratio of hydrocarbon feed to hydrocarbon-immiscible carbenium pseudo ionic liquid (or lean carbenium pseudo ionic liquid and ionic liquid) may vary greatly based, for example, on the specific carbenium pseudo ionic liquid or liquids employed, the ionic liquids used, the nature of the hydrocarbon feed (straight run or previously processed), the contaminant content of the hydrocarbon feed, the degree of contaminant removal required, the number of contaminant removal steps employed, and the specific equipment used.

The degree of phase separation between the hydrocarbon and carbenium pseudo ionic liquid phases is another factor to consider as it affects recovery of the carbenium pseudo ionic liquid and hydrocarbon. The degree of contaminant removed and the recovery of the hydrocarbon and carbenium pseudo ionic liquid may be affected differently by the nature of the hydrocarbon feed, the variations in the specific carbenium pseudo ionic liquid(s) or ionic liquid(s), the equipment, and the contaminant removal conditions such as those discussed above.

The amount of water present in the hydrocarbon/hydrocarbon-immiscible carbenium pseudo ionic liquid mixture during the contaminant removal step may also affect the amount of contaminant removed and/or the degree of phase separation, i.e., recovery of the hydrocarbon and carbenium pseudo ionic liquid. When water is present, the ionic liquid is less effective and the lifetime will be shortened. It will be quenched by the wet hydrocarbon passing over it and forming metal hydroxide salts. In an embodiment, the hydrocarbon/hydrocarbon-immiscible carbenium pseudo ionic liquid mixture has a water content of less than about 1 mol % per mol of the carbenium pseudo ionic liquid, or less than about 0.5 mol %, or less than about 0.2 mol %, or leass than about 0.1 mol %, or less than about 0.075 mol %, or less than about 0.05 mol %. In a further embodiment, the hydrocarbon/hydrocarbon-immiscible carbenium pseudo ionic liquid mixture is water free, i.e., the mixture does not contain water.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving contaminant removal, and washing zones may pass through ancillary equipment such as heat exchanges within the zones. Streams may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. The various process steps may be operated continuously and/or intermittently as needed for a given embodiment e.g. based on the quantities and properties of the streams to be processed in such steps. As discussed above the invention encompasses multiple contaminant removal steps, which may be performed in parallel, sequentially, or a combination thereof. Multiple contaminant removal steps may be performed within the same contaminant removal zone and/or multiple contaminant removal zones may be employed with or without intervening washing zones.

By the term "about," we mean within 10% of the value, or within 5%, or within 1%.

EXAMPLE 1

Experiments were performed with tert-butyl chloride ($^t$BuCl) or chlorocyclopentane and $AlCl_3$ using light cycle oil (LCO) and naphtha as feeds. To 15 g of feed, $AlCl_3$ and the organic chloride were added while stirring. After 30 min, the stirring was stopped, and two layers formed. The feed was decanted from the carbenium pseudo ionic liquid (CPIL) layer and submitted for N and S analysis.

For LCO, the nitrogen and sulfur removal using the chlorocyclopentane was similar to that using the $^t$BuCl. However, the amount of extract formed using the chlorocyclopentane was lower. A similar trend was observed for naphtha. The results are shown in Table 1.

EXAMPLE 2

Experiments were performed with an ionic liquid, tert-butyl chloride and $AlCl_{13}$ using LCO and Naphtha as feeds. To 15 g of feed, the ionic liquid (A: triisobutyl(methyl) phosphonium tosylate and B: tributyl(ethyl)phosphonium diethylphosphate), $AlCl_3$ and the organic chloride were added while stirring. After 30 min, the stirring was stopped, and two layers formed. The feed was decanted from the CPIL layer and submitted for N and S analysis.

For naphtha, the CPIL and 10 wt % IL A and B removed a similar amount of nitrogen compared to the CPIL alone, but less sulfur. The amount of extract with the CPIL and 10 wt % IL A and B was less than the CPIL alone. A similar trend was observed for LCO. The results are shown in Table 2.

TABLE 1

| | $AlCl_3$ + $^t$BuCl | $AlCl_3$ + $^t$BuCl | $AlCl_3$ + Chlorocyclopentane | $AlCl_3$ + Chlorocyclopentane |
|---|---|---|---|---|
| Feed:CPIL, by wt | 5:1 | 10:1 | 5:1 | 10:1 |
| LCO N, wt ppm, | 614 | 614 | 614 | 614 |
| LCO S, wt ppm | 28100 | 28100 | 28100 | 28100 |
| Nitrogen Removal (%) | 97 | 77 | 95 | 51 |
| Sulfur Removal (%) | 92 | 76 | 89 | 71 |
| Extract % | 43 | 34 | 36 | 10 |
| Feed:CPIL, by wt | 5:1 | 10:1 | 5:1 | 10:1 |
| Naphtha N, wt ppm, | 98 | 98 | 98 | 98 |
| Naphtha S, wt ppm | 2700 | 2700 | 2700 | 2700 |
| Nitrogen Removal (%) | 98 | 97 | 99 | 98 |
| Sulfur Removal (%) | 87 | 22 | 94 | 27 |
| Extract % | 23 | 11 | 18 | 11 |

TABLE 2

| | $AlCl_3$ + $^tBuCl$ | $AlCl_3$ + $^tBuCl$ | 90 wt % CPIL + 10 wt % A | 90 wt % CPIL + 10 wt % B |
|---|---|---|---|---|
| Feed:CPIL + IL, by wt | 5:1 | 10:1 | 5:1 | 5:1 |
| Naphtha N, wt ppm, | 98 | 98 | 98 | 98 |
| Naphtha S, wt ppm | 2700 | 2700 | 2700 | 2700 |
| Nitrogen Removal (%) | 98 | 97 | 99 | 99 |
| Sulfur Removal (%) | 87 | 22 | 68 | 59 |
| Extract % | 23 | 11 | 11 | 11 |
| | $AlCl_3$ + $^tBuCl$ | $AlCl_3$ + $^tBuCl$ | 10 wt % CPIL + 90 wt % A | 10 wt % CPIL + 90 wt % B |
| Feed:CPIL + IL, by wt | 5:1 | 10:1 | 5:1 | 5:1 |
| LCO N, wt ppm, | 614 | 614 | 614 | 614 |
| LCO S, wt ppm | 28100 | 28100 | 28100 | 28100 |
| Nitrogen Removal (%) | 97 | 77 | 70 | 38 |
| Sulfur Removal (%) | 92 | 76 | 68 | 70 |
| Extract % | 42 | 33 | 10 | 24 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A process for removing a contaminant comprising at least one of sulfur and nitrogen from a hydrocarbon stream comprising:

contacting the hydrocarbon stream comprising the contaminant with a lean carbenium pseudo ionic liquid to produce a mixture comprising the hydrocarbon and a rich carbenium pseudo ionic liquid comprising the contaminant, the carbenium pseudo ionic liquid comprising an organohalide and a metal halide with the proviso that the organohalide is not a butyl halide or acyl halide; and separating the mixture to produce a hydrocarbon effluent and a rich carbenium pseudo ionic liquid effluent comprising the rich carbenium pseudo ionic liquid comprising the contaminant.

2. The process of claim 1 wherein the organohalide comprises at least one of alkyl halides having 1-3 carbon atoms or 5-12 carbon atoms, isoalkyl halides having 3 carbon atoms or 5-12 carbon atoms, cycloalkyl halides, and combinations thereof.

3. The process of claim 1 wherein a ratio of the organohalide to the metal halide is in a range of about 1:4 to about 3:1.

4. The process of claim 1 wherein the metal halide comprises at least one of aluminum halides, iron halides, copper halides, zinc halides, cobalt halides, manganese halides, and combinations thereof.

5. The process of claim 1 wherein the hydrocarbon stream has a boiling point in a range of about 30° C. to about 610° C.

6. The process of claim 1 wherein the contacting step is conducted at at least one of: a temperature in a range of about -20° C. to about 100° C., and a pressure in a range of about 100 kPa(g) to about 3 MPa(g).

7. The process of claim 1 wherein the contacting step is conducted in an inert atmosphere.

8. The process of claim 1 further comprising passing at least a portion of the hydrocarbon effluent to a hydrocarbon conversion zone.

9. The process of claim 1 wherein a ratio of the hydrocarbon to the carbenium pseudo ionic liquid is in a range of about 1:1 to about 1000:1.

10. The process of claim 1 wherein contacting the hydrocarbon stream comprising the contaminant with the lean carbenium pseudo ionic liquid comprises contacting the hydrocarbon stream comprising the contaminant with a combination of the lean carbenium pseudo ionic liquid and a lean ionic liquid.

11. The process of claim 10 wherein a ratio of the lean carbenium pseudo ionic liquid to the lean ionic liquid is in a range of about 1:1000 to about 1000:1.

12. The process of claim 1 wherein the contaminant is sulfur, and wherein at least about 50 wt % of the sulfur in the hydrocarbon stream is removed.

13. The process of claim 1 wherein the contaminant is nitrogen, and wherein at least about 50 wt % of the nitrogen in the hydrocarbon stream is removed.

14. A process for removing a contaminant comprising at least one of sulfur and nitrogen from a hydrocarbon stream comprising:

contacting the hydrocarbon stream comprising the contaminant with a lean combination of a carbenium pseudo ionic liquid and a ionic liquid to produce a mixture comprising the hydrocarbon, and a rich combination of the carbenium pseudo ionic liquid and the ionic liquid comprising the contaminant, the carbenium pseudo ionic liquid comprising an organohalide and a metal halide; and separating the mixture to produce a hydrocarbon effluent and a contaminant rich effluent comprising the rich combination of the carbenium pseudo ionic liquid and the ionic liquid comprising the contaminant.

15. The process of claim 14 wherein a ratio of the carbenium pseudo ionic liquid to the ionic liquid is in a range of about 1:1000 to about 1000:1.

16. The process of claim 14 wherein the organohalide comprises at least one of alkyl halides, isoalkyl halides, cycloalkyl halides, or combinations thereof.

17. The process of claim 14 wherein the metal halide comprises at least one of aluminum halides, iron halides, copper halides, zinc halides, cobalt halides, manganese halides, and combinations thereof.

18. The process of claim 14 wherein a ratio of the organohalide to the metal halide is in a range of about 1:4 to 3:1.

19. The process of claim 14 wherein the hydrocarbon stream has a boiling point in a range of about 30° C. to about 610° C.

20. The process of claim 14 wherein the contacting step is conducted at a temperature in a range of about −20° C. to about 100° C. and a pressure in a range of about 100 kPa(g) to about 3 MPa(g) in an inert atmosphere.

* * * * *